United States Patent [19]

Fischer et al.

[11] 3,996,178

[45] Dec. 7, 1976

[54] MANUFACTURE OF EASY-CARE FINISHING AGENTS FOR CELLULOSIC TEXTILES

[75] Inventors: Kurt Fischer; Anna Steimmig, both of Ludwigshafen; Heinz Bille, Limburgerhof; Harro Petersen, Frankenthal; Herbert Tulo, Ludwigshafen, all of Germany

[73] Assignee: BASF Aktiengesellschaft, Ludwigshafen (Rhine), Germany

[22] Filed: Nov. 4, 1975

[21] Appl. No.: 628,799

[30] Foreign Application Priority Data

Nov. 9, 1974 Germany ..... 2453250

[52] U.S. Cl. ..... 260/29.4 R; 8/185; 252/8.8; 252/8.9; 260/67.6 R; 260/70 R; 260/67.5; 260/849

[51] Int. Cl.[2] ..... C08G 51/58; C08G 9/30

[58] Field of Search ..... 260/70 R, 29.4 R, 849, 260/67.6 R; 8/116 M, 185; 252/8.8, 8.9

[56] References Cited

UNITED STATES PATENTS

| | | | |
|---|---|---|---|
| 3,858,273 | 1/1975 | Goldstein et al. | 260/70 R X |
| 3,903,033 | 9/1975 | Chao | 260/70 |

OTHER PUBLICATIONS

Marsh, Crease Resisting Fabrics (Reinhold, 1962), pp. 119–121.

Advances in Textile Processing, I, Lynn et al., Eds., (Textile Book Publishers, 1961), pp. 159–174.

Mark et al., Chemical Aftertreatment of Textiles (Wiley–Interscience, 1971), pp. 570–575.

*Primary Examiner*—John C. Bleutge
*Assistant Examiner*—T. DeBenedictis, Sr.

[57] ABSTRACT

A process for the manufacture of stable and at the same time highly reactive, liquid easy-care finishing agents for textiles containing, or consisting of, cellulose, the agents being manufactured from urea, formaldehyde, glyoxal and an aliphatic primary amine.

1 Claim, No Drawings

MANUFACTURE OF EASY-CARE FINISHING AGENTS FOR CELLULOSIC TEXTILES

The present invention relates to a process for the manufacture of stable and at the same time highly reactive, liquid easy-care finishing agents for textiles containing, or consisting of, cellulose, the agents being manufactured from urea, formaldehyde, glyoxal and an aliphatic primary amine.

Conventionally, methylol compounds and alkoxymethyl compounds of acyclic and cyclic ureas, as well as melamines and carbamates, are employed for the easy-care finishing or shrink-resist and wrinkle-resist finishing of cellulosic textiles. However, the methylol compounds of urea have only a relative short shelf life. Furthermore, the finish produced with these compounds on fabrics is insufficiently wash-resistant, because it lacks resistance to hydrolysis. On the other hand, the methylol compounds of urea are very reactive, compared to other finishing agents. Methylol compounds of cyclic ureas, melamines and carbamates are wrinkle-resist finishing agents which give good resistance to hydrolysis. However, these compounds react substantially less readily than the methylol compounds of urea. They therefore require relatively drastic condensation conditions, which may suffice to damage the textile material or cause yellowing and the like. Furthermore, cyclic ureas based on glyoxal are relatively expensive.

It is an object of the present invention to provide a simple and economical process for the manufacture of a finishing agent which combines high reactivity with long shelf life and high stability of the finishing liquors prepared therewith, and which is furthermore sufficiently hydrolysis-resistant to ensure that the finished goods possess shrink-resistance and wrinkle-reistance which are durable to washing. In addition, the finish should preferably not have an adverse effect on the textile hand.

We have found that this object is achieved by a process for the manufacture of liquid easy-care finishing agents for cellulosic textiles, wherein, in a first process stage, one mole of a urea is heated with from 4 to 8 moles of formaldehyde in aqueous solution at a pH of from 3 to 0 for from 1 minute to 4 hours at from 60° to 100° C, thereafter, in a second stage, a primary aliphatic saturated amine of 1 to 5 carbon atoms is added at from 30° to 90° C, without significant prior change of the pH, and, after a further 2 to 120 minutes, in a third stage in the same temperature range and at a pH of from 6 to 7.5, further urea is added followed, after a further 2 to 120 minutes in the same temperature range and pH range, by the addition of glyoxal, the amounts being such that the overall molar ratio of urea : formaldehyde : glyoxal : amine is 1 : from 1.5 to 3 : from 0.1 to 0.5 : from 0.03 to 0.5, after which the entire mixture is heated for from 15 minutes to 10 hours at from 30° to 90° C, the higher temperatures corresponding to shorter times and vice versa.

For the first reaction, in acid solution, urea may be employed as a solid or as a solution, and formaldehyde may be employed as a solution or as its polymers, e.g. paraformaldehyde, trioxane or tetraoxane, or in the form of its acetals. The urea is reacted with formaldehyde in the molar ratio of from 1 : 4 to 1 : 8, preferably from 1 : 4.5 to 1 : 6, in the presence of a strong inorganic or organic acid, at a pH of from 3 to 0, to give precondensates containing urones. This condensation may be carried out at from 60° to 100° C, preferably at from 80° to 100° C.

Instead of urea, methylenediurea or polymethyleneurea or their methylol compounds may be reacted with formaldehyde to give precondensates containing urones. The mixtures resulting from the methylolation of urea with formaldehyde, which, in addition to free formaldehyde, contain, inter alia, the higher methylol compounds of urea, e.g. dimethylolurea, trimethylolurea and tetramethylolurea, may also be used as starting materials for the manufacture of the precondensates containing urones. In these cases, the formaldehyde already chemically bonded is of course counted as if it were free formaldehyde in calculating the above molar ration.

Suitable acid catalysts are inorganic acids, e.g. hydrochloric acid and sulfuric acid, and strong organic acids, e.g. p-toluenesulfonic acid, oxalic acid and phthalic acid.

The reaction in the first stage may be carried out by adding formaldehyde and an acid to one, or a mixture of several, of the above starting materials and then heating the mixture to the desired condensation temperature. However, it is also possible first to heat the mixture of the starting materials with formaldehyde or its derivatives to the condensation temperature and only then to add the acid. The reaction time depends on the temperature and on the amount of acid. At a pH of from 2.0 to 2.5 the reaction time at from 90° to 100° C is, e.g., about 30 minutes. At a pH of about 1 the reaction time can be reduced to about 1 minute.

The present invention is based on the surprising discovery that if the precondensates thus obtained, which still contain free formaldehyde, are reacted further with small amounts of a primary amine of 1 to 5 carbon atoms, and thereafter further amounts of urea are added, a reaction mixture is obtained which can then be reacted with from 0.1 to 0.5 mole of glyoxal per mole of urea to give an aqueous solution of from 30 to 80% strength, preferably from 40 to 70% strength, of an easy-care finishing agent which has the above properties. The addition of the amine in the second stage is made at from 30+ to 90° C, preferably from 40° to 80° C, the amounts of amine employed being from about 0.05 to about 1.5 moles, based on the amount of urea used in the first stage. Examples of suitable amines are methyl-, ethyl-, n-propyl-, i-propyl-, n-butyl-, i-butyl-, n-pentyl-, n-hexylamine. The addition of the amine raises the pH, at times up to about 7.5. In a third stage, urea is added at a pH of from 6 to 7.5 preferably from 6.8 to 7.5, the amount being such as to give an overall molar ratio of urea to formaldehyde of from 1 : 1.5 to 1 : 3, preferably from 1 : 2.2 to 1 : 3. In the third stage, the reaction is carried out at from 30° to 90° C, preferably from 45° to 60° C. At 50° C, the reaction in the third stage requires from about 20 to 40 minutes. From 0.1 to 0.5 mole of glyoxal per mole of urea is then added at the same pH and the same temperature and the entire mixture is heated for from 15 minutes to 10 hours at from 30° to 90° C, preferably for from 2 to 6 hours at from 45° to 60° C. FInally, the pH of the finishing agent obtained is brought to from 7.2 to 7.5 with caustic alkali or an amine of low volatility, e.g. triethanolamine.

The finishing agents manufactured by the process of the invention have a very long shelf life. At up to 40° C, the solutions remain usable for more than 6 months. Furthermore, their free formaldehyde content is relatively low, so that the odor nuisance usually encountered when handling such agents in textile finishing is negligible.

The finishing agents of the invention are used by conventional methods, preferably in the form of an aqueous impregnation bath, to which the catalysts required for crosslinking are generally added. Potentially acid catalysts which are generally known and conventional for textile finishing purposes, are particularly suitable. Examples of such catalysts are ammonium salts of strong acids, magnesium chloride, zinc chloride and zinc nitrate. Mixtures of several catalysts may also be employed. The concentration of finishing agent depends, in the usual way, on the desired effect, but is in general from 50 to 200 g/l. The goods to be treated are impregnated with the liquor by conventional methods. Preferably, a padder is employed for the purpose. The impregnated goods are freed from excess liquor by conventional methods, e.g. by squeezing-off. The impregnated goods can then be dried to a greater or lesser degree, after which they are heated, in the presence of the acid or potentially acid catalysts, to from 100° to 210° C, preferably from 130° to 180° C. In general, the reaction is completer after from 1 to 6 minutes under these conditions. The goods may be shaped mechanically during or after drying, e.g. by compression, crimping, plating, calendering, embossing or pleating. Cellulosic textiles finished in this way have a durable wrinkle-resist and shrink-resist finish, and embossed effects and pleats are relatively wash-resistant. A further advantage is that the finished textiles have a relatively soft hand.

A striking feature of the preparation of the impregnating liquors is that the liquor is very stable in the presence of the above catalysts. Whilst a liquor consisting of methylolated urea and ammonium salts or magnesium chloride is only stable for a few hours, the finishing agents of the invention under identical conditions give liquors stable for more than 24 hours. It is also surprising that the liquors of the finishing agents of the invention are very stable even after addition of free acids. This permits the use of such finishing agents even in the shock-drying condensation process.

The nitrogen-containing hydroxymethyl or alkoxymethyl compounds hitherto employed, as well as nitrogen-free finishing agents, may be used conjointly with the novel finishing agents. The conventional water-repellent agents, oil-repellent agents, plasticizers, levelling agents, wetting agents and resin finishes, e.g., in particular, solutions or dispersions of plastics, may also be present. Examples of water-repellent agents are paraffin wax emulsions containing aluminum or zirconium, and preparations containing silicones. Examples of oil-repellent agents are perfluorinated aliphatic compounds. Examples of plasticizers are oxyethylation products of higher fatty acids, fatty alcohols or fatty acid amides, high molecular weight polyglycol ethers, higher fatty acids, fatty alcohol-sulfonates, N-stearyl-N',N'-ethylideneurea and stearylamidomethylpyridinium chloride. Examples of levelling agents which may be used are water-soluble salts of acid ester, formed from polybasic acids and ethylene oxide or propylene oxide adducts of longer-chain basic starting materials which can be oxyalkylated. Examples of wetting agents are salts of the alkylnaphthalenesulfonic acids, the alkali metal salts of sulfonated dioctyl succinate and the adducts of alkylene oxides with fatty alcohols, alkylphenols, fatty amines and the like. Examples of resin finishes are cellulose ethers or cellulose esters and alginates, as well as solutions or dispersions of synthetic polymers and polycondensates, e.g. of polyethylene, polyamides, oxyethylated polyamides, polyvinyl ethers, polyvinyl alcohols, polyacrylic acid or its esters and amides and corresponding polymethacrylic compounds, polyvinyl propionate, polyvinylpyrrolidone, copolymers, e.g. of vinyl chloride and esters of acrylic acid, of butadiene and styrene or acrylonitrile, or of $\alpha$-dichloroethylene, $\beta$-chloroalkyl esters of acrylic acid or vinyl ethyl and acrylamide or the amides of crotonic acid or maleic acid, or of N-methylol-methacrylamide and other polymerizable compounds. These additional assistants are in general employed in amounts of from 0.3 to 4%, preferably from 1 to 2.5%, based on the weight of the dry textile goods, though in special cases these amounts can be exceeded.

In the Examples which follow, parts and percentages are by weight, and parts by weight bear the same relation to parts by volume as that of the kilogram to the liter.

EXAMPLE 1

3.34 parts of 75% strength sulfuric acid are added to a mixture of 1,650 parts of 40% strength formaldehyde solution and 240 parts of urea, whilst stirring, and the whole is heated to 90° C in 5 minutes and then stirred at this temperature for 30 minutes. The pH is from 1.4 to 1.5. The precondensate, containing urones, is then cooled to 50° C, 25 parts of n-butylamine are added and the mixture is stirred for 30 minutes at 50° C. The pH is brought to from 6.8 to 7.0 with sodium hydroxide solution and after adding 240 parts of urea stirring is continued for a further 30 minutes at 50° C. 232 parts of a 40% strength aqueous glyoxal solution are then added to the reaction mixture and the whole is heated at 50° C for 4 hours, whilst maintaining a pH of from 6.9 to 7.1 . After cooling to room temperature, the pH is brought to 7.5 with sodium hydroxide solution.

2,400 parts of an aqueous solution containing 48% of solids and 1.8% of free formaldehyde are obtained.

The overall molar ratio of urea : formaldehyde : glyoxal : n-butylamine is 1 : 2.75 :0.2 : 0.043.

EXAMPLE 2

3.34 parts of 75% strength sulfuric acid are added to 1,650 parts of 40% strength formaldehyde solution and 240 parts of urea and the precondensation is carried out at 90° C, as in Example 1. The precondensate is then cooled to 50° C, 45 parts of n-bulylamine are added and the mixture is heated at 50° C for 30 minutes. The pH assumes a value of from 6.8 to 6.9. 240 parts of urea are then added and the mixture is heated at 50° C for a further 30 minutes. 232 parts of a 40% strength aqueous glyoxal solution are then added to the reaction mixture and the whole is heated at 50° C for 4 hours at a pH of from 6.9 to 7.1. After the mixture has cooled to room temperature, the pH is brought to 7.5 with sodium hydroxide solution. The solution obtained has an overall ratio of urea : formaldehyde : glyoxal : n-butylamine of 1 : 2.75 : 0.2 : 0.077. The solution contains about 48% of solids and 1.7% of free formaldehyde.

EXAMPLE 3

A precondensate is prepared by the process described in Example 1 from 1,650 parts of 40% strength formaldehyde solution, 240 parts of urea and 3.34 parts of 75% strength sulfuric acid. After it has cooled to 50° C, 125 parts of n-butylamine are added and the mixture is stirred for 30 minutes at 50° C. The pH assumes a value of from 6.8 to 7.0. 240 parts of urea are then added and stirring is continued for 30 minutes at 50° C. 232 g of a 40% strength aqueous glyoxal solution are then added to the reaction mixture and the whole is heated at 50° C for 4 hours whilst maintaining the pH at from 6.9 to 7.1. 2,490 parts of an aqueous solution containing 49% of solids and from 1.6 to 1.7% of free formaldehyde are obtained. The overall molar ratio of urea : formaldehyde : glyoxal : n-butylamine is 1 : 2.75 : 0.2 : 0.215.

EXAMPLE 4

960 parts of an aqueous methylolation mixture of urea and formaldehyde in the molar ratio of 1 : 4.8, with an overall content of 60% of formaldehyde and 25% of urea, are brought to a molor ratio of urea : formaldehyde = 1 : 5.5 by adding 210 parts of 40% strength formaldehyde solution. 3.2 parts of 75% strength sulfuric acid are added to the mixture which is then heated to 90° C in about 5 minutes, and stirred at the same temperature for 30 minutes. The reaction mixture, containing urones, is then cooled to 50° C, 45 parts of n-butylamine are added and the mixture is stirred for 30 minutes at 50° C. After bringing the pH to from 6.8 to 7.0, 240 parts of urea are added and stirring is continued for 30 minutes at 50° C. 232 parts of a 40strength aqueous glyoxal solution are then added to the reaction solution and the mixture is heated for 4 hours at 50° C and a pH of from 6.9 to 7.1. After the mixture has cooled to room temperature, the pH is brought to 7.5 with sodium hydroxide solution. 1,640 parts of an aqueous solution containing 70% of solids and 2.7% of free formaldehyde are obtained. The overall molar ratio of urea : formaldehyde : glyoxal : n-butylamine is 1 : 2.75 : 0.2 : 0.077.

EXAMPLE 5

1,650 parts of 40% strength formaldehyde solution and 350 parts of 68.5% strength urea solution are mixed in a flask equipped with a stirrer, 3.2 parts of 75% strength sulfuric acid are added and the mixture is heated to 90° C in 5 minutes, and stirred for 30 minutes at the same temperature. The pH is from 1.5 to 1.6. The reaction mixture, containing urones, is then cooled to 50° C, 60 parts of a 50% strength aqueous ethylamine solution are added, and the whole is stirred for 30 minutes at 50° C. The pH assumes a value of from 6.8 to 6.9. 350 parts of 68.5% strength urea solution are then added and stirring is continued for 30 minutes at 50° C. 232 parts of a 40% strength aqueous glyoxal solution are then added to this reaction solution, and the whole is heated for 4 hours at 50° C and a pH of from 6.9 to 7.1. After the mixture has cooled to room temperature, the pH is brought to 7.5 with sodium hydroxide solution. 2,640 parts of an aqueous solution containing 43% of solids and about 2.5% of free formaldehyde are obtained. The overall molar ratio of urea : formaldehyde : glyoxal : ethylamine is 1 : 2.75 : 0.2 : 0.083.

EXAMPLE 6

3.2 parts of 75% strength sulfuric acid are added to a mixture of 1,650 parts of 40% strength formaldehyde solution and 350 parts of 68.5% strength urea solution, whilst stirring, and the whole is heated to 90° C in about 5 minutes, and stirred for 30 minutes at the same temperature. The reaction mixture, containing urones, is then cooled to 50° C, 45 parts of n-butylamine are added and the whole is stirred for 30 minutes at 50° C. The pH assumes a value of from 6.8 to 6.9. After adding 350 parts of 68.5% strength urea solution, the reaction mixture is stirred for a further 30 minutes at 50° C. 232 parts of a 40% strength aqueous glyoxal solution are then added thereto, the pH is brought to form 7.0 to 7.1 with sodium hydroxide solution, and the whole is heated at 50° C for 4 hours, whilst maintaining this pH. After the mixture has cooled to room temperature, the pH is brought to 7.5 with sodium hydroxide solution. 2,620 g of a finishing agent containing 44of solids and about 2.5% of free formaldehyde are obtained. The overall molar ratio of urea : formaldehyde : glyoxal : n-butylamine is 1 : 2.75 : 0.2 : 0.077.

Use of the product

A. A bleached and mercerized cotton poplin fabric weighing 120 g/m² is padded with a solution prepared by diluting 100 parts of the 44% strength finishing agent manufactured as described above, and 30 parts of crystalline magnesium chloride, with water, to 1,000 parts by volume. The wet pick-up is 70%.

The impregnated fabric is dried at 110° C until its residual moisture content is 10% and is finally subjeted to condensation at 160° C for 4 minutes.

A very good wash-fast, wrinkle-resist and shrink-resist finish is obtained, as demonstrated by the data in the Table in comparison with an identical fabric finished under identical conditions with the identical amount of dimethylol-4,5-dihydroxyethyleneurea, which is a relatively expensive chemical.

| | | a | b | c |
|---|---|---|---|---|
| Dry crease angle (warp and weft) [°] | | 64 | 206 | 198 |
| after 3 × 120 min machine wash at the boil | | 64 | 168 | 168 |
| Wet crease angle (warp and weft) [°] | | 129 | 240 | 234 |
| after 3 × 120 min machine wash at the boil | | 179 | 237 | 240 |
| Monsanto drip-dry rating | | 1.5 | 4.25 | 4.25 |
| Tensile strength (50 × 200 mm), kg | | 44.0 | 28.0 | 24.0 |
| Shrinkage [%] after 3 × 120 min machine wash at the boil | warp | 9.0 | 1.5 | 1.5 |
| | weft | 4.5 | 1.0 | 1.0 |

a Untreated comparative fabric
b Example 6 A
c Dimethylol-4,5-dihydroxyethyleneurea a. Untreated comparative fabric
b. Example 6 A
c. Dimethylol-4,5-dihydroxyethyleneurea B. A viscose staple fabric weighing 125 g/m² is impregnated with a finishing liquor prepared by diluting 250 parts of the finishing agent prepared as described above (Example 6), and 5 parts of ammonium chloride, with water to 1,000 parts by volume.

The wet pick-up is 90%.

The impregnated fabric is pre-dried as described under A) and then subjected to condensation for 4 minutes at 130° C. Good crosslinking - as demonstrated by a comparison with dimethylolurea and dimethylol-4,5-dihydroxyethyleneurea — is achieved at the relatively low condensation temperature of 130°0 C, which therefore allows the treatment to be carried out without damage to the fibers.

| | | a | b | c | d |
|---|---|---|---|---|---|
| Dry crease angle (warp and weft) [°] | | 63 | 179 | 173 | 120 |
| Shrinkage [%] after 1 × 20 min wash under conditions for delicate fabrics | warp | 10.0 | 1.5 | 2.0 | 5.0 |
| | weft | 7.0 | 1.5 | 2.0 | 5.5 |

a Untreated comparative fabric
b Dimethylolurea
c Example 6 B
d Dimethylol-4,5-dihydroxyethyleneurea a. Untreated comparative fabric
b. Dimethylolurea
c. Example 6 B
d. Dimethylol-4,5-dihydroxyethyleneurea C. A white 50:50 polyester/cotton union fabric weighing 100 g/m² is impregnated with a solution prepared by adding water to 100 parts of a product prepared as described above (Example 6), 15 parts of crystalline magnesium chloride and 5 parts of 57% strength glycollic acid, to give 1,000 parts by volume. The pH of the liquor is from 2.8 to 3. The wet pick-up is 70%.

The impregnated fabric is dried, and subjected to condensation, in a single step of one minute at 200° C.

This finish gives a very resilient soft hand. In spite of the high condensation temperature, the fabric retains a high degree of whiteness.

The relatively acid solution is stable for 72 hours. In contrast, dimethylolurea undergoes condensation within the first 30 minutes.

EXAMPLE 7

3.2 parts of 75% strength sulfuric acid are added to a mixture of 1,650 parts of 40% strength formaldehyde solution and 350 parts of 68.5% strength urea solution, whilst stirring, and the whole is heated to 90° C in 5 minutes, and stirred for 30 minutes at the same temperature. Thereafter the reaction mixture, containing urones, is cooled to 50° C, 45 parts of isobutylamine are added, and the mixture is stirred for 30 minutes at 50° C. The pH assumes a value of from 6.8 to 6.9. After adding 350 parts of 68.5% strength urea solution the mixture is stirred for a further 30 minutes at 50° C. 232 parts of a 40% strength aqueous glyoxal solution is then added to the reaction solution, the pH is brought to from 6.9 to 7.0 and the whole is heated at 50° C for 4 hours whilst maintaining this pH. After the mixture has cooled to room temperature, the pH is brought to 7.5 with triethanolamine. 2,620 parts of a finishing agent containing about 44% of solids and 1.9% of free formaldehyde are obtained. The overall molar ratio of urea : formaldehyde : glyoxal : isobutylamine in the solution is 1 : 2.75 : 0.2 : 0.077.

EXAMPLE 8

120 parts of urea are dissolved in 600 parts of 40% strength formaldehyde solution, and 3.5 parts of 75% strength sulfuric acid are added at 80° C, the process being caried out in a stirred apparatus. The reaction mixture is then stirred for 5 minutes at 90° C. The pH assumes a value of from 0.75 to 0.8. After the mixture has cooled to 70° C, 116.8 parts of n-butylamine are added and the whole is stirred for 40 minutes at 70° C, the pH being 7.4. 120 parts of urea are then added and after bringing the pH to from 6.5 to 6.8 with sulfuric acid, the reaction mixture is heated at 70° C for 30 minutes. It is then cooled to 50° C and stirred, after adding 232 parts of a 40% strength glyoxal solution, for 4 hours at 50° C and pH 7.2.

1,190 parts of a finishing agent of 52% solids content are obtained.

The overall molar ratio of urea : formaldehyde : glyoxal : n-butylamine is 1 : 2 : 0.4 : 0.4.

EXAMPLE 9

0.2 part of 75% strength sulfuric acid is added to a mixture of 900 parts of 40% strength formaldehyde solution and 120 parts of urea and the whole is heated to 95° C in about 5 minutes and stirred for 30 minutes at the same temperature. The pH of the mixture is from 2.2 to 2.3. The precondensate is then cooled to 80° C, 146 parts of n-butylamine are added whilst cooling, and the reaction mixture is stirred for 30 minutes at 80° C. It is then cooled to 50° C, 120 parts of urea are added, and the whole is stirred further 30 minutes at 50° C and pH 7.5. 290 parts of a 40% strength glyoxal solution are then added and the mixture is heated at 50° C for 4 hours whilst maintaining a pH of from 7.2 to 7.3. 1,570 parts of a finishing agent of 50% solids content are obtained.

The overall molar ratio of urea : formaldehyde : glyoxal : n-butylamine in the product is 1 : 3 : 0.5 : 0.5.

EXAMPLE 10

60 parts of urea are dissolved in 376 parts of a 40% strength formaldehyde solution, and after adding 1.2 parts of 75% strength sulfuric acid the mixture is stirred for one hour at pH 1 and 80° C, the process being carried out in a stirred apparatus. After cooling to 40° C, 44 parts of n-butylamine are added and the mixture is stirred for 50 minutes at 40° C, at which stage the pH is from 7.1 to 7.2. 60 parts of urea are then added and the mixture is heated to 60° C. After 10 minutes, 87 parts of a 40% strength glyoxal solution are added and the reaction mixture is heated for one hour at 60° C. 620 parts of an aqueous finishing agent of 51% solids content are obtained. The overall molar ratio of urea : formaldehyde : glyoxal : n-butylamine is 1 : 2.5 : 0.3 : 0.3.

We claim:

1. A process for the manufacture of stable, highly reactive, liquid easy-care finishing agents for cellulosic textiles, the agents being based on urea, formaldehyde and glyoxal, wherein, in a first process stage, one mole of urea is heated with from 4 to 8 moles of formaldehyde in aqueous solution at a pH of from 3 to 0 for from one minute to 4 hours at from 60° to 100° C, a second stage, a primary aliphatic saturated amine of 1 to 5 carbon atoms is added at from 30° to 90° C, without significant prior change of the pH, and, after a further 2 to 120 minutes, in a third stage in the same temperature range and at a pH of from 6 to 7.5, further urea is added followed, after a further 2 to 120 minutes in the same temperature range and pH range, by the additional of glyoxal, the amounts being such that the overall molar ratio of urea : formaldehyde : glyoxal : amine is 1 : from 1.5 to 3 : from 0.1 to 0.5 : from 0.03 to 0.5, after which the entire mixture is heated for from 15 minutes to 10 hours at from 30° to 90° C.

* * * * *

UNITED STATES PATENT AND TRADEMARK OFFICE

CERTIFICATE OF CORRECTION

PATENT NO. : 3,996,178

DATED : December 7, 1976

INVENTOR(S) : FISCHER et al

It is certified that error appears in the above-identified patent and that said Letters Patent are hereby corrected as shown below:

In Column 8, Line 54, delete " ... 60° to 100° C, a second ..." and substitute -- ... 60° to 100° C, in a second ... --

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*